US008458980B2

(12) United States Patent
Ivanov

(10) Patent No.: US 8,458,980 B2
(45) Date of Patent: Jun. 11, 2013

(54) MODULAR BUILDING CONSTRUCTION

(76) Inventor: Nikolay Vaskov Ivanov, Plovdiv (BG)

( * ) Notice: Subject to any disclaimer, the term of this patent is extended or adjusted under 35 U.S.C. 154(b) by 0 days.

(21) Appl. No.: 13/389,232

(22) PCT Filed: Aug. 7, 2009

(86) PCT No.: PCT/BG2009/000011
§ 371 (c)(1),
(2), (4) Date: Feb. 6, 2012

(87) PCT Pub. No.: WO2011/014936
PCT Pub. Date: Feb. 10, 2011

(65) Prior Publication Data
US 2012/0131878 A1 May 31, 2012

(51) Int. Cl.
*E04C 2/42* (2006.01)
*E04C 5/04* (2006.01)
*E04F 15/06* (2006.01)
*E04F 19/10* (2006.01)

(52) U.S. Cl.
USPC ..... 52/668; 52/79.1; 446/105; 446/106; 446/122; 446/476

(58) Field of Classification Search
USPC ..... 52/79.1, 79.12, 660, 663, 664, 666, 52/668, 655.1; 446/85, 105, 106, 122, 476, 446/478
See application file for complete search history.

(56) References Cited

U.S. PATENT DOCUMENTS 2,335,181 A 11/1943 Heath
2,384,303 A * 9/1945 Heath ..... 52/668
2,854,724 A * 10/1958 Wuorio ..... 249/168
3,807,116 A 4/1974 Flynn
4,227,358 A 10/1980 Gat et al.
4,585,422 A * 4/1986 Kay ..... 446/106
4,785,604 A * 11/1988 Johnson, Jr. ..... 52/668

(Continued)

FOREIGN PATENT DOCUMENTS

AU 634975 B2 3/1993
BE 540481 A 8/1955

(Continued)

OTHER PUBLICATIONS

International Search Report for International Application No. PCT/BG2009/000011; Date of Completion: May 26, 2010; Authorized Officer: Hubert Porwoll.

*Primary Examiner* — Brian Glessner
*Assistant Examiner* — Brian D Mattei
(74) *Attorney, Agent, or Firm* — Michael A. Mann; Nexsen Pruet, LLC

(57) ABSTRACT

The invention relates to the field of construction and in particular to a modular construction system used for building of construction modules. The construction system comprises plurality of flat elements (1) with identical thickness C and having slots (3) on at least one of its long sides (4), as the slots (3) are located at a distance from each other so that the flat elements (1) can intersect each other through their slots (3) in order to form a grid. The elements (1) of the system have slots (3) located at equal distances n or b from each other where the ratio n:b is within the range from 1:1 to 1:10. The building construction module is made as three-dimensional frame structure shaped like polyhedron including a floor (20), a ceiling (21) and at least two walls (22) grids connected together. The grids are made by intersecting through slots (3) flat elements (1).

9 Claims, 9 Drawing Sheets

U.S. PATENT DOCUMENTS

| | | | | |
|---|---|---|---|---|
| 5,157,892 | A * | 10/1992 | Ryther | 52/793.11 |
| 5,580,294 | A * | 12/1996 | Briant | 446/110 |
| 6,256,960 | B1 | 7/2001 | Babcock et al. | |
| 7,114,300 | B1 * | 10/2006 | Culp | 52/211 |
| 2005/0069387 | A1 * | 3/2005 | Arollanes | 405/114 |
| 2006/0218872 | A1 * | 10/2006 | Bigott | 52/660 |
| 2008/0163580 | A1 | 7/2008 | Meiser et al. | |

FOREIGN PATENT DOCUMENTS

| | | | |
|---|---|---|---|
| CN | 2446159 | Y | 9/2001 |
| DE | 803422 | C | 12/1951 |
| DE | 1044380 | B | 11/1958 |
| DE | 20100630 | U1 | 4/2001 |
| EA | 011657 | B1 | 6/2007 |
| EP | 0033257 | A1 | 8/1981 |
| EP | 0458703 | B1 | 2/1995 |
| EP | 1662065 | A2 | 5/2006 |
| FR | 2736073 | A1 | 1/1997 |
| GB | 409323 | A | 4/1934 |
| GB | 982239 | A | 2/1965 |
| GB | 985338 | A | 3/1965 |
| GB | 1010812 | A | 11/1965 |
| GB | 1019628 | A | 2/1966 |
| GB | 1102597 | A | 2/1968 |
| GB | 1138956 | A | 1/1969 |
| GB | 1530896 | A | 11/1978 |
| JP | 11172847 | A | 6/1999 |
| RU | 2182206 | C1 | 5/2002 |
| WO | WO00/28166 | | 5/2000 |
| WO | WO02/077383 | A1 | 10/2002 |
| WO | WO2006/063143 | A2 | 6/2006 |
| WO | WO2006/101413 | A1 | 9/2006 |
| WO | WO2006/132569 | A1 | 12/2006 |
| WO | WO2007/054512 | A1 | 5/2007 |
| WO | WO2008/040755 | A1 | 4/2008 |

* cited by examiner

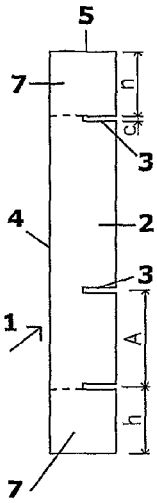
Fig 1a
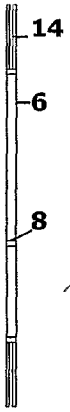
Fig 1b
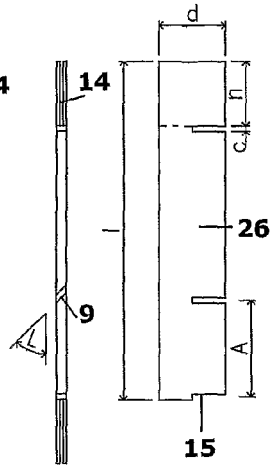
Fig 1c
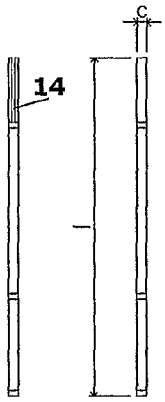
Fig 1d
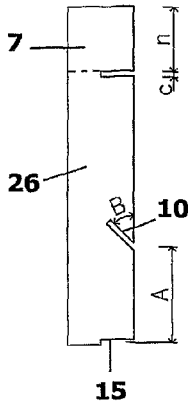
Fig 1e
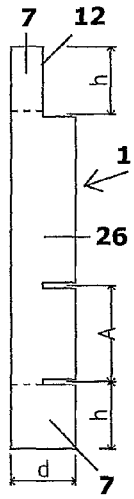
Fig 1f
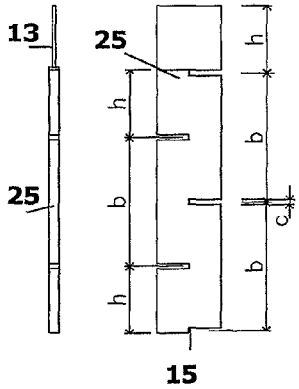
Fig 1g
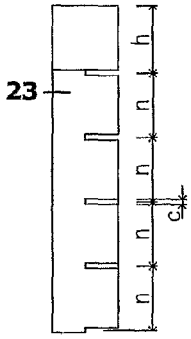
Fig 1h
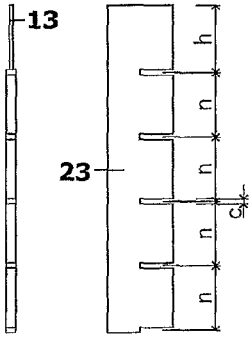
Fig 1k
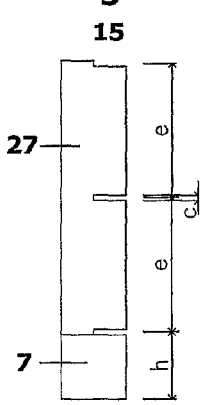
Fig 1l
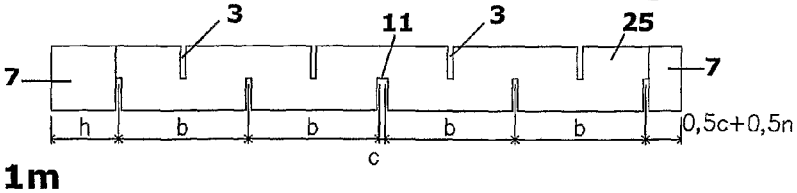
Fig 1m
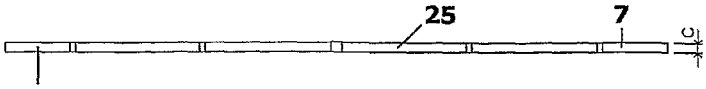
Fig 1n
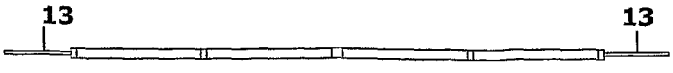
Fig 1o
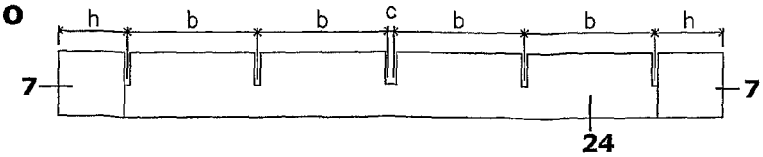

MODULAR BUILDING CONSTRUCTION

FIELD OF THE INVENTION

The present invention relates to the field of construction and in particular to a construction system, a building construction module and a method for building construction. The system can be applied in construction of buildings both by assembling of prefabricated horizontal and standing grids or prefabricated building construction three-dimensional modules, and by connection of the elements on the construction site. It is appropriate for use in the low-rise, middle-rise and high-rise buildings. The system can also be applied for production of construction toys as well as for making architectural models.

BACKGROUND OF THE INVENTION

There are a great number of construction systems using prefabricated elements. Their main advantage is that they ensure easy and quick construction and allow avoiding wet processes on the construction site. Ways and means for decrease of the construction costs as well as for provision of higher rigidity of the buildings have been sought. It is also important that these systems provide great variety of architectural projects with a view to the uniqueness of the building at the same time preserving its rigidity.

Some problems have been outlined in the use of prefabricated modular elements and three-dimensional (3D) section modules in the construction. The conventional way of constructing multi-storey buildings is to arrange these modules one above of the other. This requires that each module has sufficient strength in vertical direction in order to support the weight of the modules laid above it. It is normal to look for the optimal unification of modules in order to satisfy both the strength requirements and the requirements for decrease of the element weight combined with higher economic efficiency of the construction.

A great part of the construction systems based on prefabricated modular elements use elements shaped as solid walls, floors or ceilings (for example WO2007/054512). These construction systems have the following disadvantages: a lot of material is used for them; the structures are very heavy and are not appropriate for prefabrication of 3D modular construction sections which increases the time of construction. There are construction systems made of prefabricated 3D construction modular cells which can be connected with each other in horizontal or vertical direction. For example, GB 985338, GB 1019628 and GB 1010812 disclose 3D construction modules made as a load bearing frame structures forming non-solid floor, ceiling and walls to which interior and exterior facade panels are installed in addition. The main disadvantage of such construction modules with frame structures is that a lot of material is used for their production and that they can be connected to each other by laying concrete on the joints in-situ. A lot of manual labour is used which increases the construction time. Moreover, they do not provide sufficient rigidity of the construction module. The fact that they cannot be used in the construction of interior elements such as recesses, wall cupboards, etc. is also important.

The use of different grids in construction of floors, walls, staircases, balconies, terraces, window frames or facade elements is also very common in the different construction systems. The main advantage of the grid structures is that they have very high load bearing capacity. For example, DE 803422 discloses a floor construction grid made of elongated flat elements with slots which are perpendicular to the plane and are located at equal distance from each other, and the elements intersect through the slots to form a grid. WO 2006/101413, published also as EA 011657, discloses another construction system of elongated elements with perpendicular slots at equal distances from each other, in which the elements intersect to form a grid and the elements are with square section. These types of grids can be used in the in-situ construction of buildings but they cannot be used for 3D building structures as they do not allow joining elements in height.

Well known, for example, are DE 1044380, GB 1102597, DE 20100630, US 2008/0163580, EP 0033257, GB 1102597, EP1662065 and a great number of other construction systems by means of which grid structures can be built. The elements of such systems are made of elongated flat metal elements with perpendicular slots at equal distance from each other and the elements intersect each other through the slots. The grids comprise exterior frames by which they are strengthened. They can be used in construction but they cannot be used for construction of 3D building construction modules as they do not allow joining elements in height.

Another construction system is also well known from RU 2182206 (also published as WO 02/077383) which comprises a great number of elongated flat elements of equal thickness, marked here with "c", and each of the flat elements has slots on at least one of the long sides located at such distance from one another so that the flat elements could intersect each other through the slots in such a way so as to form a grid. The elements of this system have equal thickness which makes their unification easier. The slots of this system are, however, situated in regularly repeated groups and the distances used are 2c and 2c-300c which makes the grid structurally dependent on the thickness "c", and subsequently—on the material used. Besides, in this system the constructed grid have sections with different dimensions and area which leads to uneven loadings and requires thicker distribution layer transferring the direct loads on the grid. A disadvantage of the prior art system is that it cannot be used for construction of 3D space construction modules as it does not allow joining additional elements in height. Another disadvantage is that the constructed grid structure cannot be effectively used in designing the interior spaces.

DE 803422 discloses a method for construction of buildings on a foundation comprising the steps parallel arranging to each other flat elements with slots at equal distance from each other so that the element plane is perpendicular to the foundation plane and the slots on the one of the long sides are directed upwards; intersecting at equal distances the other flat elements through the slots and fixing at an angle in order to form a horizontal grid of the floor with openings of equal dimensions. This method cannot be used for construction of 3D space building structures and for production of prefabricated construction modules. The method is labour-intensive and slow.

SUMMARY OF THE INVENTION

An object of the present invention is to provide a construction system as well as a building construction module which can guarantee easy and quick erection of building structures with high rigidity and great variety of spatial solutions.

The proposed construction system comprises plurality of elongated flat elements of equal thickness c, each of the flat elements having slots at least on one of the long sides through the whole thickness c of the elements and the slots are located in such a way so that the flat elements can intersect each other through the slots in order to form a grid with total height equal to the width d of the flat element with the biggest width. At least two flat elements of the system have slots located at equal distances n from each other. At least two flat elements have slots located at equal distance b from each other where the ratio n:b is within the range from 1:1 to 1:10. In one of the preferred embodiments the ratio n:b is within the range from 1:1.5 to 1:10. At least two flat elements have at least two slots located at distance e from each other and at least two other flat elements have at least two slots located at distance A, where the distances e and A are independent of each other and they are independent of the distance n, where each of the distances e and A is within the range from 0.2b to 10b. The slots at the ends of at least two flat elements are at distance h equal to at least 0.5 n from the edge of the short side of the element. The advantage of this system is that its elements are structurally independent of the thickness "c" and, therefore, from the type of the material used. It may be constructed uniform grids having openings equal in dimensions and area which leads to even distribution of loads allowing for the use of thinner distribution layer transferring the direct loads to the grid. It may be constructed irregular grids having unequal openings, depending of the requirements. Moreover, steady three-dimensional (3D) frameworks of the building structures of grid type can be easily and quickly erected using the elements of the so described construction system, where the density of the grid can be chosen depending on the requirements for load bearing capacity. Construction modules with compatible grids of different density multiple to n and b for the floor and the ceiling can be constructed which can penetrate into each other when two construction modules are connected in height. The wall grids can have different density thus providing the possibility for forming window areas to meet specific requests. This allows the reducing of the wet processes in construction which decreases the time of construction. Besides, this allows for the production of prefabricated 3D modular construction cells. This also ensures great variety of architectural spatial solutions. The system can be used for covering big spans without using other type of support and the structure is extremely rigid. The elements can be unified which allows reducing their number.

In one embodiment of the present invention, the construction system comprises at least two flat elements with slots on the two long sides located in a chess-board order and the distances between the slots on each of both sides are equal to b. The system may comprise also at least two flat elements with slots on the two long sides located in a chess-board order and the distances between the slots on each of both sides are equal to e as well as at least two flat elements with at least one transversal slot with width equal to at least 2*c*. Such implementation of the flat elements increases the system possibilities for construction of a next story or semi-story in height, for construction of stabilizing girdles as well as the possibilities for large cantilever projections.

In another embodiment the construction system further comprises at least two flat elements one end of which after the last slot has a cut from the slot to the end of the element and also comprises at least two flat elements the one end of which ends with a slot, so that to form a step with the size of the slot and the slots at the ends of at least two flat elements are at distance h equal to n+0.5c from the edge of the short side of the element.

In yet another embodiment of the invention the ratio between the width d of the flat element and its thickness c is within the range from 1:1 to 30:1, preferably from 1.5:1 to 30:1. This allows to significantly reducing the weight of the structure constructed from the system elements.

In yet another embodiment of the invention the construction system comprises at least two flat frames, preferably composite made of flat elements connected between each other and the frames themselves constitute flat polygons. Each frame has at least one side with width equal to the width of the flat elements and each side of each frame has slots so that the frame can be intersected with any flat element through the slots. At least one of the frame sides has slots from the side of the opening. This version additionally widens the system possibilities.

The invention is also related to a building construction module made as a three-dimensional frame structure with a shape of a polyhedron and having connected together a floor, a ceiling ant at least two walls. The floor and the ceiling of the module are grids including flat elements intersecting each other through slots. The flat elements in at least one direction along the module width or length, of at least one of the grids of the ceiling and/or floor have free slots which allows the grid of the floor of a module to penetrate into the grid of the ceiling of other module by intersecting through the free slots of the respective flat elements. At least one of the grids of the floor or the ceiling comprises first flat elements with slots situated at equal distance n from each other. At least one of the grids of the floor and/or the ceiling comprises second flat elements with slots located at equal distance b from each other, where the ratio n:b is within the range from 1:1 to 1:10, preferably from 1:1.5 to 1:10, and the second elements with slots at distance b are located in different direction towards the first elements with slots at distance n, preferably at an angle of 90°; the slots at the ends of at least two flat elements of the grids of the ceiling and/or floor are at distance h equal to at least 0.5c from the edge of the short side of the element. At least two walls connecting the floor and the ceiling are grids made of connected through slots standing and horizontal flat elements along the height and width of the walls accordingly, so that the corresponding horizontal elements lay at equal distances from the floor thus forming different levels. The ends of at least two standing elements are connected at an angle, preferably 90°, to the ends of the corresponding elements of the floor and the ceiling. The so chosen ratios n:b ensure possibility for construction of great variety of floor and ceiling grids which can penetrate into each other thus providing wide range of possibilities for firmly connection of two modules one over the other.

In another embodiment of the invention the horizontal elements have at least two slots located at distance e from each other and the standing elements have at least two slots located at distance A from each other, where the distances e and A are independent of each other and they are independent of distance n. Each of the distances e and A is within the range from 0.2b to 10b. The wall grids are independent from the grids of the floor and the ceiling and thus they allow various wall bays and window openings to be formed.

In yet another embodiment of the construction module according to the invention the walls are opposite. The ends of the corresponding horizontal elements (27) of both walls (22) are connected at least at two levels to the ends of second horizontal elements (29) with slots located at equal distances e, positioned so that the flat walls of the elements are parallel to the plane of the ceiling and/or floor in order to form at least two stabilizing girdles crossing also at least one module wall connecting the opposite walls. The second horizontal elements of the stabilizing girdles intersect in vertical direction through its slots with standing elements having at least two slots located at distance A, so that the other module walls are formed as grids. This additionally strengthens the module and makes it separate.

The construction of three-dimensional grid modules has immense advantages. Statically each of the modules acts as independent structure capable of taking enormous loads. Thus the static model of the building becomes extremely rigid. Each of the modules can take the loads during the transportation and assembly without being deformed as the wall structure is of a grid type. The use of elements with elongated rectangular sections makes the structure suitable for maximum effective taking of loads. Some other advantages of the three-dimensional building construction module according to the invention are that it can be prefabricated in a factory and be completely finished with all facade and floor constructing layers. Such module has low dead load which makes its transportation and installation easy and decreases the time for construction. The hollows formed by the grids can be used for building-in of lighting fixtures, for recesses and cupboards thus providing functional freedom in the interior design.

In yet another embodiment of the invention at least one of wall grids comprises along its width flat elements having slots located in a chess-board order on both long sides and the distances between the slots on each of both sides are equal to e. The slots on one side of the element are vacant and are intended for connecting through analogous vacant slots with the wall of another module. Thus one wall of one module may be connected with the wall of another module so that to form mutual wall grid, which makes the construction more compact.

The invention relates to a method for construction of buildings as well. The method includes the steps of arrangement of the first flat elements having slots at equal distance and parallel to each other so that the element plane is perpendicular to the plane of the foundation and the slots on one of the long sides of the elements are directed upwards; and the step of intersecting and fixing, at an angle and at equal distances, second flat elements through their slots so that to form a horizontal grid of the floor with identical dimensions of the openings. The method also includes the steps of fixing to the ends of at least three standing elements with slots to the ends of the first and/or second flat elements; the step of intersecting the standing elements through the slots of at least two horizontal elements with slots in order to form grids of at least two walls; the step of connecting the corresponding ends of the standing elements to the ends of third elements with slots so that the slots on one long side of the third elements are directed upwards; and the step of intersecting through the slots the third elements with fourth elements with slots so that a ceiling grid is formed thus forming an independent module and at least one of the grids of the ceiling, floor or walls has vacant slots for connection to the grids of other identical or different modules. The advantages of this method are that the building is constructed of prefabricated light elements avoiding wet processes on the construction site and providing for high rigidity. In a preferred embodiment of the invention the slots of the elements are at distance n or b or e, and the ratios n b are in range from 1:1 to 1:10, preferably from 1:1.5 to 1:10, and the distance e is independent from the distance n, preferably it is in the range from 0.2b to 10b.

In one preferred embodiment of the method the steps of building the grids of the floor, ceiling and walls of the module are performed in advance, after which the ends of the elements of the wall grids are fixed to the ends of the elements of the floor grid and the ends of the elements of the ceiling grid are fixed to the free ends of the wall grids.

In another embodiment of the method after the building up of module it includes the steps of connecting by intersecting through their vacant slots of elements of the walls of the module with elements of the walls of other prefabricated modules in horizontal direction so that to form a mutual partition wall grid or by intersecting in vertical direction the vacant slots of the ceiling grid of the module and the vacant slots of the floor grid of other prefabricated modules so that to form a mutual grid, and if required it follows a repeating of the above described steps.

In another preferred embodiment of the method modules are assembled in advance outside the construction site, transported to the site, connected and fixed to each other and/or to the foundation. In case of need the modules are connected to each other in horizontal direction through vacant slots on the wall grids and/or are connected in vertical direction through vacant slots on the ceiling grids of the lower module and on the floor of the upper module. In this case it is possible to achieve the quickest and easiest way of building construction with possibility for the biggest module unification.

The invention also includes use of the elements of the construction system like structural elements for construction toys or for making architectural models.

BRIEF DESCRIPTION OF THE DRAWINGS

Examples showing the present invention are provided in the attached figures, where.

FIGS. from 1*a* to 1*u* show a bird's-eye view and/or side view of different embodiments of flat elements according to the invention.

DETAILED DESCRIPTION OF THE INVENTION

The present invention is demonstrates in the attached figures and is visualized by the examples below which serve only as illustration.

The construction system includes elongated flat elements. It can also include flat frames.

Figure 1P:
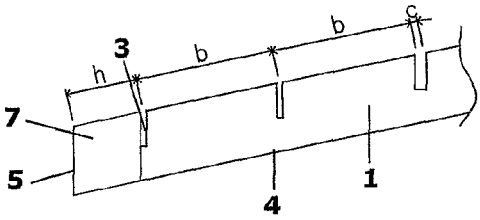
Figure 1Q:
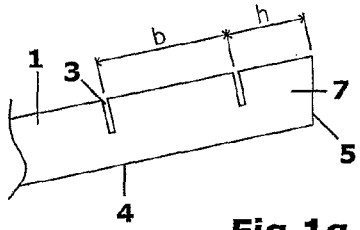
Figure 1R:
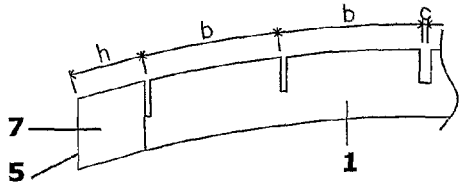
Figure 1S:
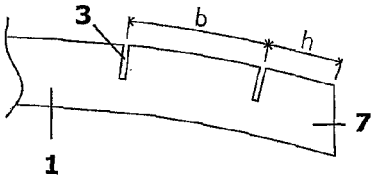
Figure 1T:
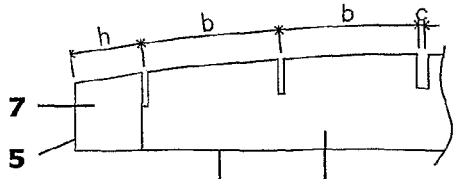
Figure 1U:
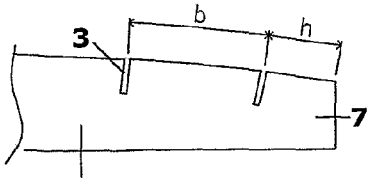

Different embodiments of elongated flat elements 1 which together or separately, in different combinations, can form system elements are presented in FIGS. from 1*a* to 1*u*. The flat elements 1 can be rectangular (FIGS. 1*a*-1*o*), rhomboidal (FIGS. 1*p*-1*q*), curved (FIG. 1*r*, 1*s*) or arch-shaped (FIGS. 1*t*, 1*u*). Other shapes, not shown in the figures, like corrugated, triangular and other flat shapes depending on the specific architectural project are also possible. The flat elements can have different length l and different width d. Each flat element 1 includes a body 2 and slots 3. The bodies 2 have long sides 4 which constitute the element length l as well as short sides 5 constituting the element width d. The long sides 4 and the short sides 5 form two parallel walls 6 of the flat body 2. The two walls 6 constitute the element thickness c. The bodies have ends 7, but they can end with an open slot 3 at least of one end 7 having a width d, so that to form a little cut. The slots 3 can be transversal 8, situated perpendicularly to the long sides 4 or transversal 9, situated at an angle α to the flat walls 6, as shown in FIG. 1*b*. The slots 3 can also be inclined 10 towards the long sides 4 at an angle β, as shown in FIG. 1*e*. The slots 3 can be situated unilaterally (FIGS. 1*a*, 1*c*, 1*e*, 1*f*, 1*h*, 1*k*, 1*l* and 1*o*) or bilaterally in a chess-board order (FIGS. 1*g* and 1*m*). At least one slot 11 has width bigger than the width of the rest of the slots 3, as it could be seen in FIG. 1*o*. The width of the slot 11 is selected so that two other flat elements 1 can fit and connected cross-like in along its thickness c. The slots 3 can be parallel to the short side 5 of a rhomboidal flat element 1, as shown in FIG. 1*p*, or perpendicular to its long sides 4, as shown in FIG. 1*q*. The slots 3 can be located evenly at distances n or b along the length of the body 2 (FIGS. 1*g*, 1*h*, 1*k*, 1*m* and 1*o*) or to be unevenly distributed as shown in FIGS. from 1*a* to 1*f*. In the curved elements the slots 3 can be made which are located along the curvature radius (FIG. 1*s*), or the slots 3 can be made parallel to the short side 5 of the element (FIG. 1*r*). Slots 3 can also be made in arch-shaped elements and they shall be located along the curvature radius (FIG. 1*u*) or slots 3 can be made parallel to the short side 5 of the element or perpendicular to the long side 4 (FIG. 1*t*). The ends 7 of the bodies 2 can be solid, as shown in FIG. 1*k*. In a version of a rectangular flat element 1, as shown in FIG. 1*f*, one end of which is a cut 12.

Figure 2:
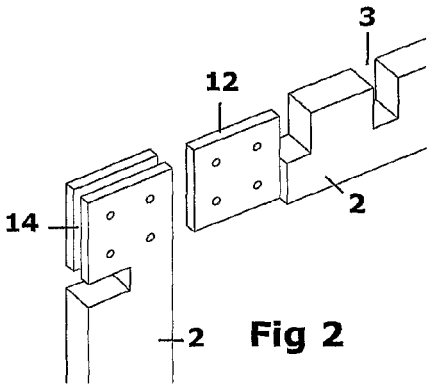
FIG. 2 shows one example of forming an end of the flat elements from FIG. 1.
Figure 3:
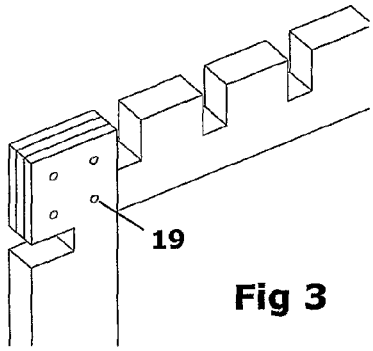
FIG. 3 shows a connection of flat elements with ends according to FIG. 2.

In one embodiment shown in FIG. 2 and FIG. 3, at least one end 7 of the body 2 of a flat element 1 is made in order to form a centrally situated part 13 with thickness smaller than the thickness of the body 2. At least one end 7 of the body 2 of another flat element 1 is made with a cut 14 in the material along the element thickness so that in side elevation view a U-shaped section is formed along the whole width of the end 7, in which cut 14 the end 13 of another flat element 1 with a smaller thickness can fit as shown in FIG. 3.

Figure 4:
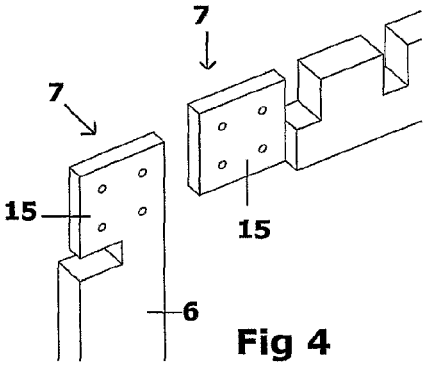
FIG. 4 shows another variant of making ends of the flat elements from FIG. 1.
Figure 5:
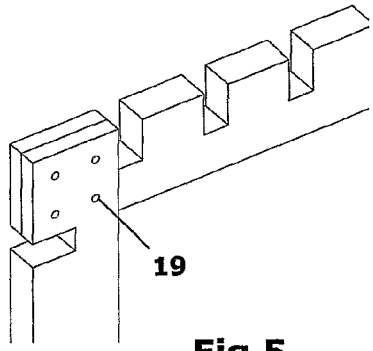
FIG. 5 shows connection of flat elements with ends according to FIG. 4.

Another variant of making the ends 7 is shown in FIG. 4. Here the ends 7 of at least two elements 1 are cut out to form a step 15 with smaller thickness, the step 15 is shifted to the flat wall 6 so that when connecting with the reciprocal step 15 of the end 7 of the other element to preserve the element thickness as shown in FIG. 5. This connection can be securing by using the standard methods, for example by bolts.

It is possible a connection between two elements whose ends do not have thinner parts or cuts (not shown in the drawings). Such connection can be made for example by welding, bolt connection, by riveting or by using other well known methods and means. It is also possible a connection between the ends along the length of the element, so that to form a long composite element (not shown in the drawings).

Figure 6:
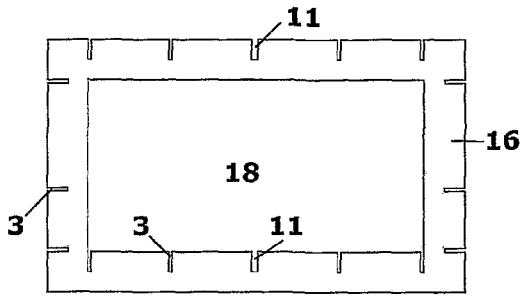
FIG. 6 shows a rectangular flat frame.
Figure 7:
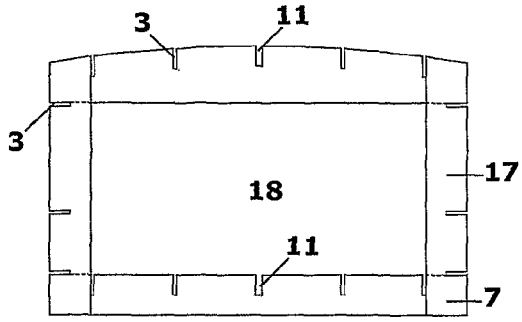
FIG. 7 shows another variant of a flat frame.

Embodiments of flat frames 16 and 17 are shown in FIG. 6 and FIG. 7. the frames 16, 17 can be polygonal, preferably quadrangular. An embodiment, not shown in the drawings is also possible, where at least one of the frame sides is open. Frame 16 can be a solid structure as shown in FIG. 6. In one preferred embodiment shown in FIG. 7 the frame 17 is composite and made of connected identical or different flat elements 1 depending on the needs, in this particular case three rectangular elements 1 and one arch-shaped element 1. Examples of different connections of the elements are shown in FIG. 3 to FIG. 6. The frames can also be other flat polygons such as triangular, rectangular or pentagonal in shape. In FIG. 6 all sides of frame 16 have width equal to the width of the flat elements and in FIG. 7 the arch-shaped wall has bigger width as a result of the curvature. Each side of each frame 16 or 17 has slots 3 which are outside and/or inside the opening 18 of the frame, so that the frame 16 or 17 can intersect any flat element 1 through the slots 3. In this particular case frames 16 and 17 have slots 3 from the side of the opening 18. The frames can also be polygons open from one side (not shown in the drawings). The use of solid frames is quite limited. They are mainly suitable for small dimensions of the build premises but the composite frames can be used in large-scale construction as well. The frames can also be used successfully for construction toys or for making architectural models.

The construction system includes at least two elements of 1, slots 3 of which are evenly situated at distance ft from each other which is shown in FIG. 1*h* and FIG. 1*k*. The distance n can vary depending on the needs, preferably, from 30 cm to 300 cm. Another element 1 is shown in FIG. 1*o* in which slots 3 are located unilaterally at second distance b and fulfilling the condition that n:b shall be within the range from 1:1 to 1:10. Preferably the range is from 1:1.5 to 1:10. Elements 1 are shown in FIG. 1*g* and FIG. 1*m* where slots 3 are located on both sides in a chess-board order one opposite to another along the element length at distance b between two adjacent slots. In shown FIGS. 1*a* to 1*o* the elements 1 are rectangular, but they can be of other type, for example rhomboidal, curved, arch-shaped or other not shown form.

Elements 1 are shown in FIG. 1*a* to FIG. 1*f* where two of the slots 3 are at third distance A independent from the distances n or b, and element 1 is shown in FIG. 1*l* where two of the slots 3 are at fourth distance e independent from the distances n, b or A. The distances A and e are structurally determined depending on the architectural design in the range from 0.2b to 10b. It is preferred that distances A and e falls each within the range from 30 cm to 300 cm.

The dimensions of the flat elements can be chosen in accordance with the application of the construction system. When used in building construction it shall conform to the architectural design. Their length l can vary depending on the dimensions of the premises. For example the length is 610 cm, 375 cm or 310 cm. it is clear that other lengths can also be chosen. The thickness c of all flat elements and frames is one and the same, for example 5 cm, but it can also be within the range, for example from 0.2 cm to 60 cm depending on the needs. The width d of the elements shall be selected to correspond to the chosen thickness c. For example, it is recommended that the ratio d:c between the width and the thickness should be within the range from 1:1 to 30:1, preferably from 1.5:1 to 30:1, in order to ensure the maximum rigidity. For illustration purposes only, thickness of 5 cm can be selected for width of 60 cm of the rectangular flat element. Respectively, the width of the all slots 3, transversal 8 and/or 9, as well as inclined 10, shall correspond to the thickness c of the elements. It is convenient that the depth of the transversal slots 8 or 9 is equal to half of the width of the short sides 5 of a rectangular element but any other combinations are also possible.

When the construction system is used for other purposes, for example, for construction toys or for making architectural models the dimensions shall be correspondingly changed but the ratio shall be preserved.

The materials which can be used for production of flat elements 1 and of frames 16 and 17 are different depending on their functions. For example they can be made of steel, solid wood, multilayer glued wood, OSB (Orientiert Strand Bord) boards and chip boards, cement fibre board sheets, concrete fibre boards, plastics, gypsum fibre board sheets as well as any other known in the art building materials.

The fixation of the connection between two intersected elements can be provided by using standard means, mentioned in general with reference 19, which are well known in the art, for example strengthening by L-shaped profiles, profiles of 'shoe' type, plates etc. for transversal strengthening of intersected elements and/or by bolt connections when connecting elements in their ends.

Figure 8:
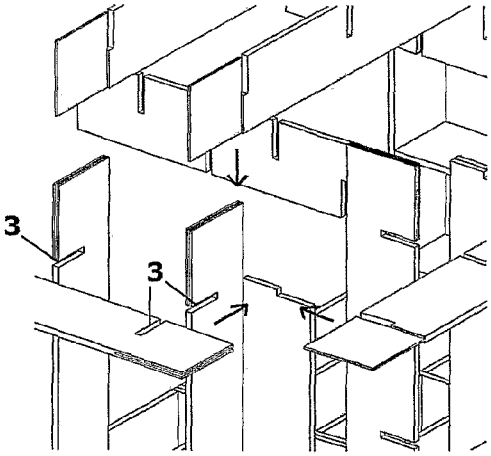
FIG. 8 shows connection of a three-dimensional grid structure in axonometric view.
Figure 9:
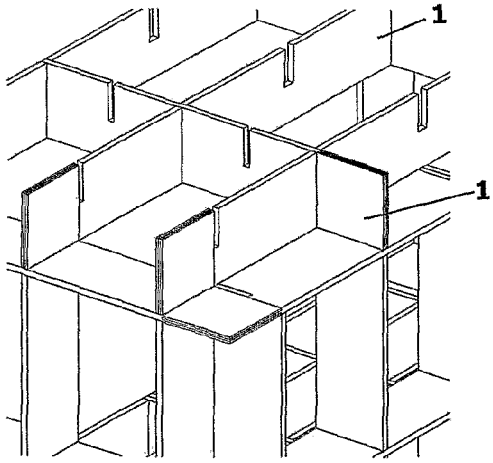
FIG. 9 shows the ready structure from FIG. 8.

The connection of a three-dimensional grid structure made of rectangular flat elements 1 is shown in FIG. 8. The arrows mark the direction of movement and intersection of elements 1 at the place of slots 3. FIG. 9 shows the completed three-dimensional grid structure from FIG. 8.

Figure 10:
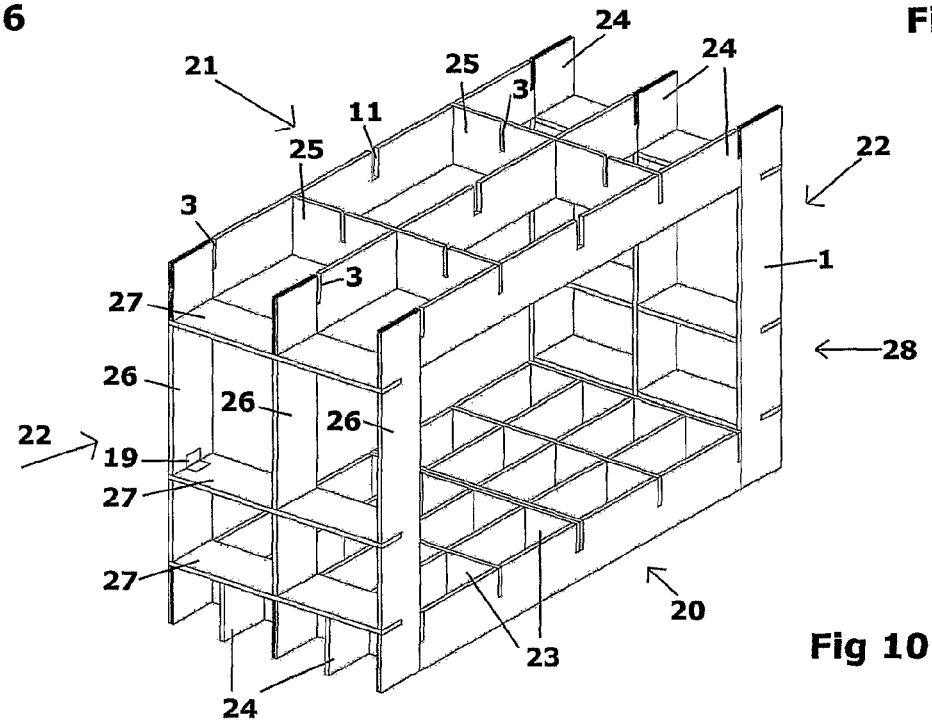
FIG. 10 shows assembled three-dimensional construction module M1 having grids of the floor, ceiling and two opposite walls.
Figure 14:
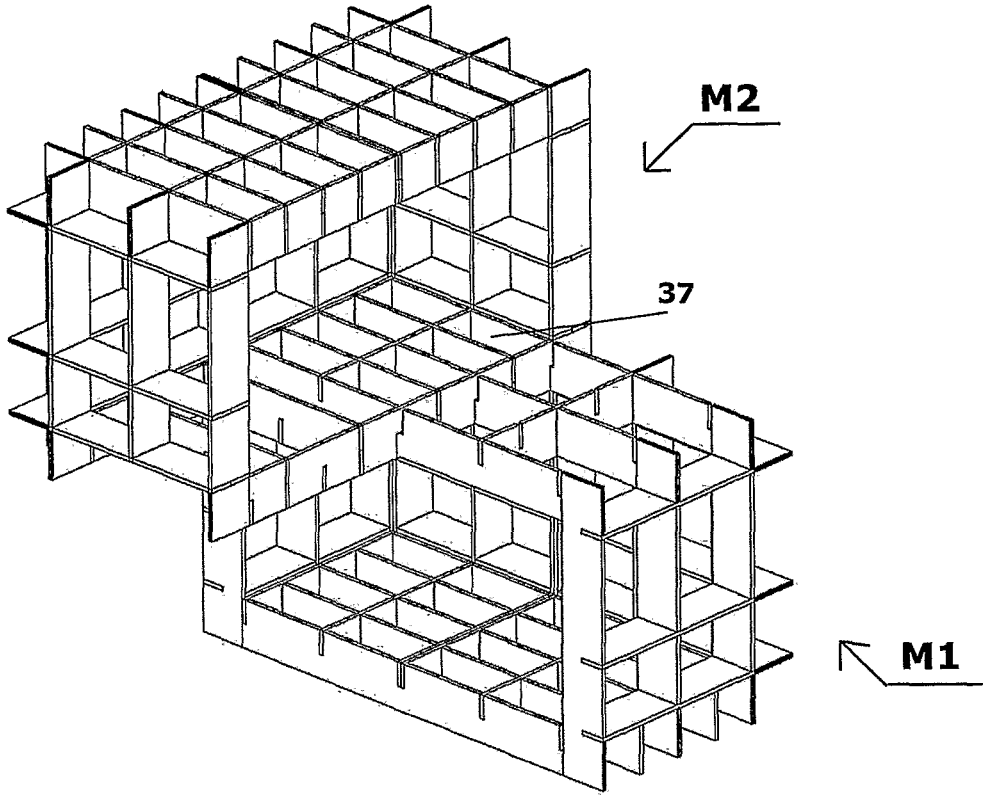
FIG. 14 shows a variant of connection of modules M1 and M2.
Figure 15:
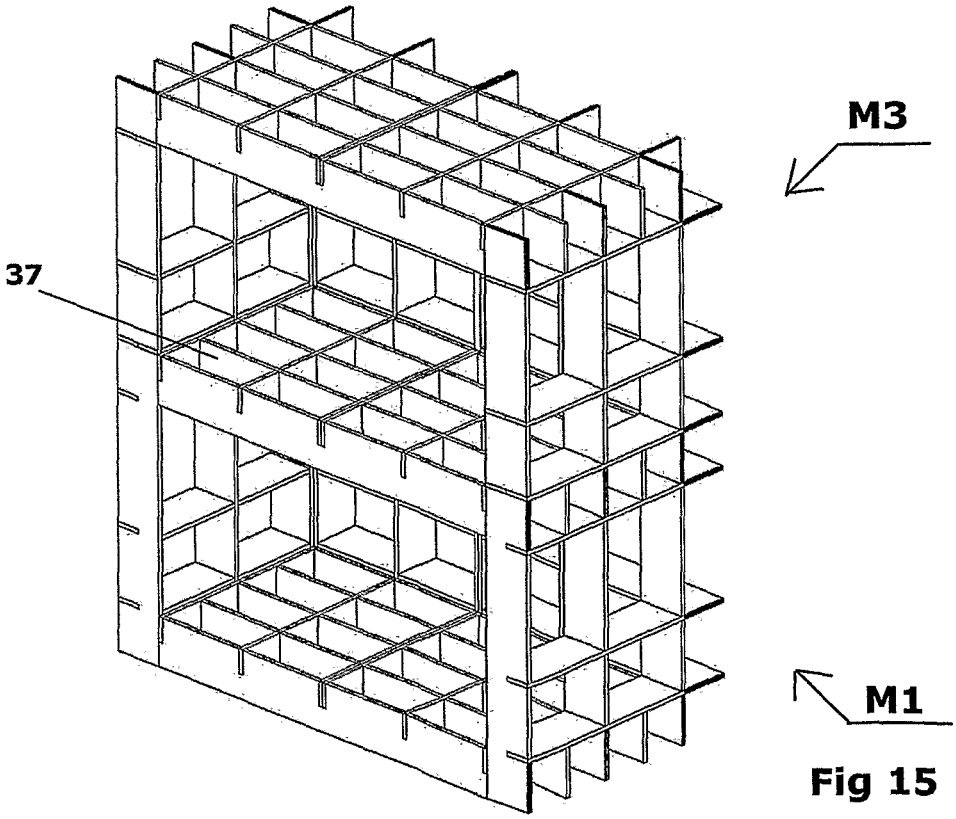
FIG. 15 shows a elevation view of a variant of a possible connection of modules M1 and M3.

FIG. 10 shows one example of a three-dimensional building construction module M1, having a floor 20, a ceiling 21 and walls 22, which shall be described in detail. The floor 20, the ceiling 21 and two opposite walls 22 constitute grids obtained as a result of intersection of flat elements 1, in this particular case—rectangular, which elements can differ in longitudinal and transversal direction of the grid, for example elements with different ends 7, or ending with open slot. For example in this case the floor 20 is a dense grid obtained by intersection of five flat elements 1 with evenly distributed slots 3 at distance n in transversal direction, designated with reference 23 on the drawing, and five flat elements 1 with evenly distributed slots 3 at distance b in longitudinal direction, designated with reference 24 on the drawing. In this specific example all flat elements 23 have width of 60 cm, flat elements 23 have length of 245 cm and the distances n are also 60 cm. Elements 24 in this case have length of 610 cm and the distances b are equal to 120 cm. Elements 24 are selected to have five slots 3 with width of 5 cm located at equal distances of 60 cm and the middle slot 3 has thickness equal to 2c, in this particular case—10 cm. In this example the second and the fourth inner longitudinal elements 24 have solid ends with thickness d and the first, third and fifth longitudinal elements 24 are made with ends of U-shaped profile in thickness. Elements 23 and 24 of the floor grid 20 are intersected through all slots. A grid of high density of openings is formed without free slots of the included elements. The ceiling 21 in this case is made by intersection of three identical flat elements 24 in longitudinal direction and two identical flat elements in transversal direction, designated with reference 25 on the drawing, the last having slots 3 at chess-board order on both long sides 4 and the distances between the slots 3 on each of both sides 4 are equal to b. Elements 25 are selected with length of 245 cm and have slots 3 located at the same distance b in a chess-board order on each side 4. The ends of elements 25 are solid without thinner parts and are ending with step 15 formed by open slot. Elements 24 of the ceiling in this case are chosen to have length of 610 cm and the distance h of both ends 7 is equal to 60 cm. In this case slots 3 on the upper long sides 4 of transversal elements 25 of the ceiling 21 are left vacant. Three of the slots 3 of the longitudinally situated elements 24 are also left vacant. The vacant slots 3 of elements 24 and 25 of the ceiling serve to connect another module on the top as shown in FIG. 14 and FIG. 15. So build, the ceiling grid of module M1 has larger openings than the openings of the floor grid. The walls of the module are made as wall grids 22 obtained by intersecting, in this particular case, three standing elements, designated with reference 26 on FIG. 10 and FIGS. 1*a* to 1*f*, and three horizontal elements, designated with reference 27 on FIG. 10 and FIG. 1*l*. Here, the polyhedral three-dimensional frame structure is strengthened at three levels by intersecting the standing elements 26 and the horizontal elements 27. The standing elements in this case have three slots 3 and the two lower slots are at distance A from each other, as shown in FIGS. 1*a* and 1*f*. The horizontal elements have three slots 3 at distance e and one of the slots 3 ends as a small end cut. Thus the two opposite walls 22 of the building construction module M1 form wall grids. The distances A in this case are chosen to be equal to 90 cm. The flat walls 6 of the horizontal elements 27 of the wall grids 22 are parallel to the planes of the floor 20 and ceiling 21 of the module. The ends of the standing elements 26 of the wall grids of opposite walls 22 are connected to the ends of the corresponding elements in the respective direction of the grids of the floor 20 and the ceiling 21 at an angle, in this case at an angle of 90°, towards the planes of floor 20 and ceiling 21. In this case the standing elements are three in number, but they can be equal to 2, 4, 5 or other whole number depending of the specific case, as their number is in relation of the number of slots at distance e of the horizontal elements 27.

In the shown embodiment of the module M1 it is with open long walls 28 which are not made as grids. This module M1 can be used as basic module for connection with other modules in horizontal direction when greater premises are required or in vertical direction when the next story or semi-story has to be constructed. It is preferable the vacant slots of each grid for connecting with a grid of another module of floor, ceiling or wall to be located at the external side of the module.

Figure 11:
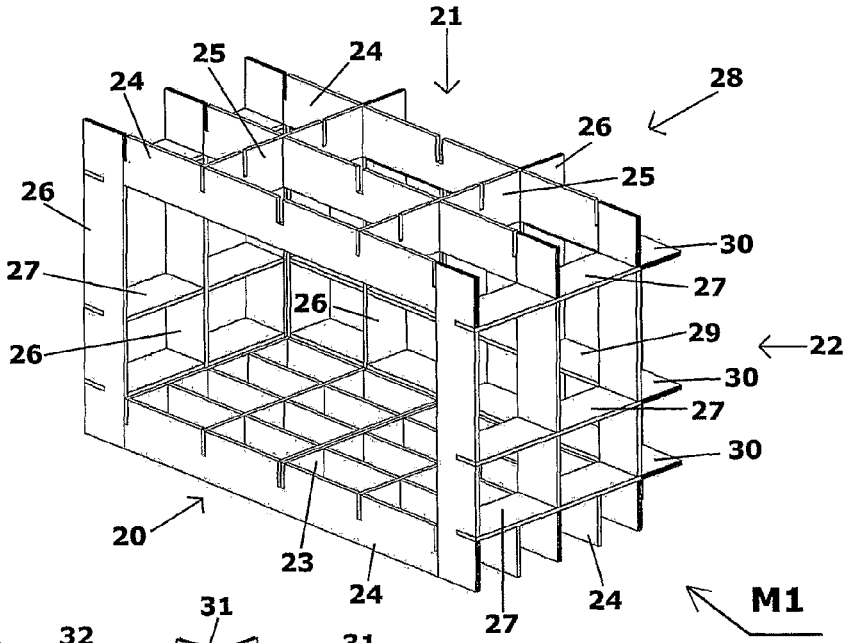
FIG. 11 shows front elevation view of a variation of a three-dimensional construction module M1 with stabilizing girdles.

FIG. 11 shows the same module M1 from FIG. 10 where the corresponding horizontal elements 27 of the opposite wall grids 22 are connected to second horizontal elements 29 with evenly distributed slots 3 at equal distance e in this case, in order to form stabilizing girdles 30 whose plane in this particular case is parallel to the planes of the ceiling 21 and floor 20. The second horizontal elements 29 of the girdles 30 are intersected in height with standing elements 26 having at least two slots 3 located at the same distances A so that the third wall 28 form a grid too. It is clear that the distances A and e between the slots of the wall grids are independent from each other, as well as they are independent from the distances b and n between the slots of the floor and ceiling grids, but for a given construction they are constant and invariable. Thereby the distance e can be chosen depending of the needs. However in some particular cases the distance e can be identical of the distances n or b, but this is not mandatory.

Figure 12:
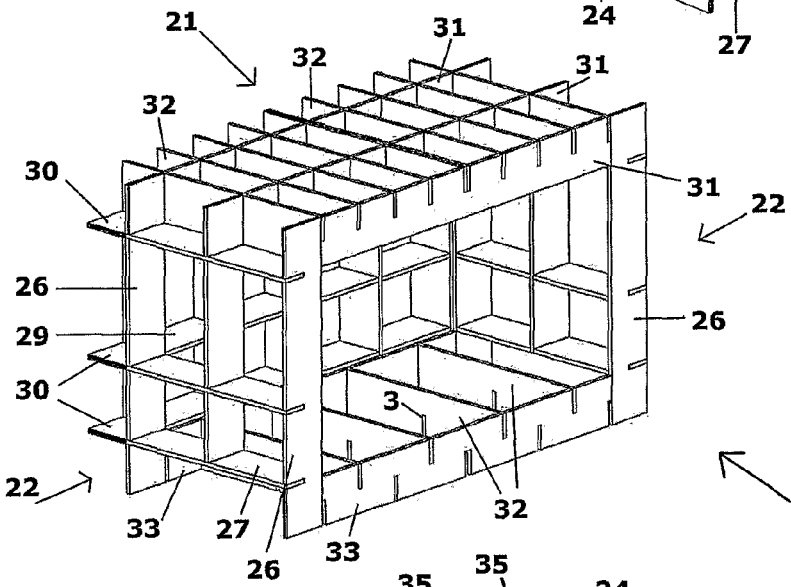
FIG. 12 shows front elevation view of a second variation of a three-dimensional construction module M2 with stabilizing girdles.

FIG. 12 shows other module M2, compatible with module M1. The differences with the first module M1 are that the ceiling grid of M2 is the denser grid and the floor grid is with larger openings in comparison with the openings of the ceiling. On FIG. 12 the designations of the flat elements in the case of module M2 have different references only for clearness and for distinguishing from the corresponding elements of the previous described module M1, since they can be of different performance. In longitudinal direction the ceiling grid of module M2 is constructed by three flat elements 1, designated with reference 31 in FIG. 12. The elements 31 have slots 3 at equal distances n, the same as in module M1, in this case equal to 60 cm, which are intersecting in transversal direction with nine flat elements 32, where the distance between the two slots 3 and the distance between the one slot 3 and the respective short side 5 are equal and correspond to the distance b, in this case chosen to be equal to 120 cm. The floor grid of the module M2 is build up by intersecting of two external flat elements 33 in longitudinal direction having slots in chess-board order with flat elements 32 in transversal direction, four in this case. Elements 33 are with length of 610 cm and the slots are at the same distances b of 120 cm as the elements 24 and 25 of the ceiling grid of the module M1. The transversal flat elements 32 of the floor grid 20 of the module M2 have vacant internal slots 3, by intersecting of which through the vacant slots 3 of the ceiling of module M1 it can be situated one over another both modules M1 and M2, as it is shown in FIG. 14. Three stabilizing girdles 30 are made in the same way.

Figure 13:
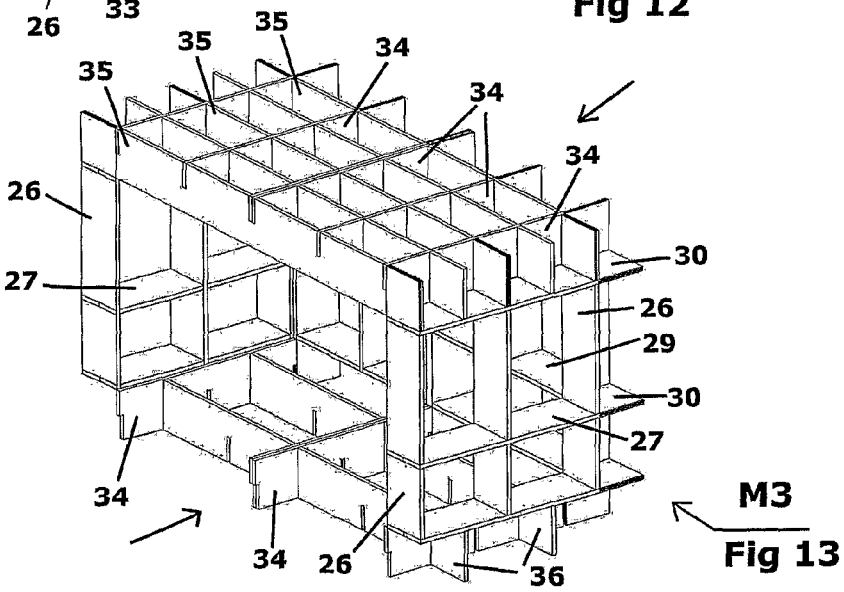
FIG. 13 shows front elevation view of a third variant of a three-dimensional construction module M3 with stabilizing girdles.

Other module M3 which can be constructed using the system elements is shown in FIG. 13. In this module M3 the ceiling 21 is constructed as dense grid made by intersecting flat elements 34 with distance between the slots n in transversal direction and flat elements 35 with distances between slots b in longitudinal direction. In the example the flat elements 34 and 35 have length equal to 305 cm and 610 cm respectively. In this case the ceiling grid of this module M3 is identical to the floor grid of module M1. The floor 20 of module M3 is made by intersecting three flat elements 34 with distance between the slots n in transversal direction and two flat elements 36 with slots located in a chess-board order at distance b on each side 4 of the element in longitudinal direction. Vacant slots underneath have been left in the flat elements in both directions. The so formed grid can be intersected through the left vacant slots in the ceiling grid of module M1 in order to arrange modules M1 and M3 one above the other as shown in FIG. 15. Three stabilizing girdles 30 are made in the same way as in modules M1 and M2.

The grids of floor 20, ceiling 21 or walls 22 and 28 can be made of elements with different width d (not shown in the drawings) in each of the constructed modules. For example the transversal elements of the floor and the ceiling have smaller width than the width of the longitudinal elements. This decreases the amount of the used material in the structure. When applied to the wall grids 22 and 28 as well, the possibilities for making the interior space increase.

The dimensions of the modules can vary according to the needs of the building. It is preferable the width of the module to be in the range from 1.5 m to 7.5 m, the length of the module to be chosen in the range from 2.0 m to 22.0 m, and the height to be in the range from 2.0 m to 9.0 m.

Two exemplary schemes of connecting modules M1 and M2 (FIG. 14) and modules M1 and M3 (FIG. 15) in vertical direction are shown in FIG. 14 and FIG. 15. The modules have a mutual grid or a part of grid. It can be seen that the system is very flexible and offers a lot of various architectural solutions. The possibility for construction of various roof and facade structures when using flat elements with shape different from rectangular, for example rhomboid, arch-shaped or curved is not shown in the figures.

Figure 17:
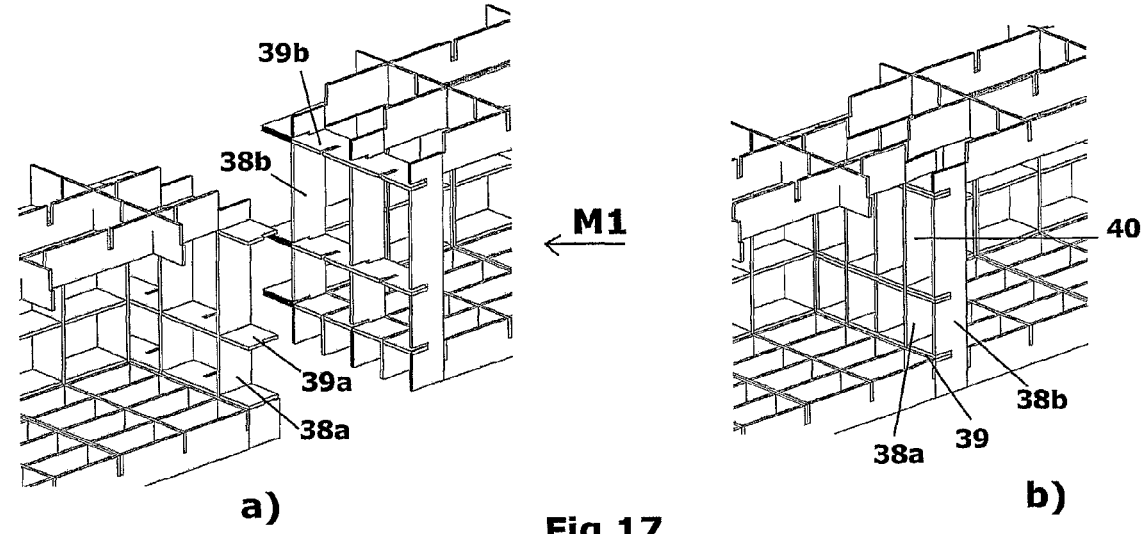
FIGS. 17*a* to 17*b* show the steps of connecting of the walls of two prefabricated modules M1.
Figure 16:
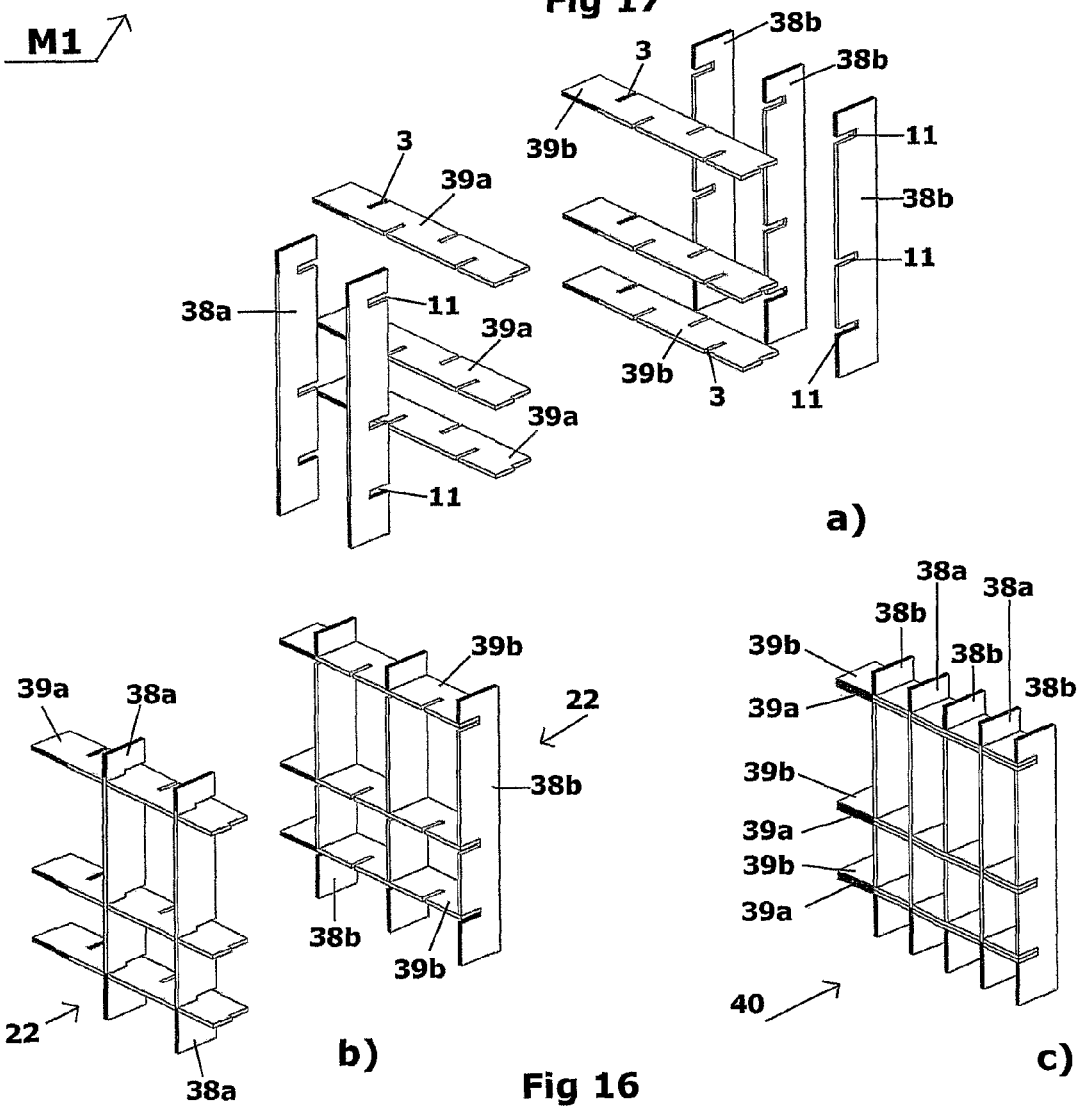
FIGS. 16*a* to 16*c* show steps for construction and connecting of module walls forming a mutual partition wall.

In this case modules are shown where one of the ceiling grids in modules M2 and M3 or of a floor grids in module M1 have the maximum possible density of openings and no vacant slots are left though which other modules in vertical direction to be connected. The system allows construction of other modules (not shown in the drawings) where the grids of the floor and the ceiling include vacant slots in one or in both transversal and longitudinal directions for connection to other modules. In this way intermediate stories of the buildings can be constructed. The system allows constructing wall grids common for two adjacent modules which increase the design freedom. In FIG. 16 and FIG. 17 one exemplary connecting of the walls of two adjacent modules so as to form a mutual wall grid between them is shown. The modules can be each of the shown in the drawing M1, M2 or M3, or another not shown in the drawings module. Element-by-element building of the wall grids, which must be joined, is shown in FIG. 16*a*. In FIG. 16*b* prefabricated wall grids are shown, which are intended for joining to each other, and in FIG. 16*c* a joining of the wall grids of two adjacent modules is shown. The standing flat elements 1, designated in this case in FIG. 16 with reference 38, have three unilateral situated slots 11 with width 2*c*, and the lower two slots 11 are at distance A from each other. One of the wall comprises in this case two standing elements 38*a*, and the second wall comprises three standing elements 38*b*. Elements 38*a* and 38*b* of both walls are intersected and stabilizing with three horizontal elements 1 in this case, being flat elements having slots in chess-board order distance e on both sides. In this case the flat horizontal elements are designated with references 39*a* for the first wall and 39*b* for the second wall, which slots 3 have width C. The standing elements 38*a* of the first wall are situated so as to have a possibility for intersecting through the vacant slots of the horizontal elements 39*b* of the second wall, so as to form a mutual wall grid 40. The horizontal elements 39*a* and 39*b* of both walls are intersected with the standing elements 38*a* and 38*b* through their wider slots 11. FIGS. 17*a* and 17*b* show analogical connecting of the wall grids of two adjacent modules.

In FIG. 18*a-h* a process of erection of construction module M1 element-by-element is shown. The module can be used for erecting buildings with the elements of the construction system. The method of building construction on a foundation includes the following steps: parallel arrangement to each other of first flat elements, in this case 24, which have slots 3 located unilaterally at equal distance b, so that the plane of elements 24 is perpendicular to the foundation plane and slots 3 of one of the long sides 4 of elements 24 are directed upwards. Intersecting, through its slots 3 and fixing at an angle, in this case at an angle of 90°, second flat elements, in this case 23, which have slots 3 at equal distances n so as to form dense horizontal grid of floor 20 with openings of identical dimensions. The method further comprises the steps of fixing to the ends of the first flat elements 24 or 25 at an angle, preferably 90°, the ends of at least two standing elements 26 with slots 3 at distance A; intersecting standing elements 26 through slots 3 in transversal direction with horizontal elements 27 with slots 3 at a distance e so that the grids of opposite walls 22 to be formed; connecting of the ends of the standing elements 26 with the ends of third flat elements 24 with slots 3 at equal distances b in this case, so that the slots 3 of one of the long sides 4 of the elements 24 are directed upwards; and intersecting through slots 3 fourth elements 25 with slots with a chess-board order distance b so that a ceiling grid 21 to be formed thus making an independent basic module M1. This basic module M1 can be connected by intersecting, through slots 3, with wall or the floor of other modules M1 in horizontal direction as shown in FIG. 16 and FIG. 17 or with other modules M2 and/or M3 with floor grids 20 different from the floor grid of the basic module M1 in vertical direction as shown in FIG. 14 and FIG. 15. This could be made by repeating the above described steps. The strengthening of the connections can be made by using standard and well known means 19, for example in case of intersecting with V-shaped steel elements and when connecting ends by bolts, welding, riveting, etc.

Figure 18:
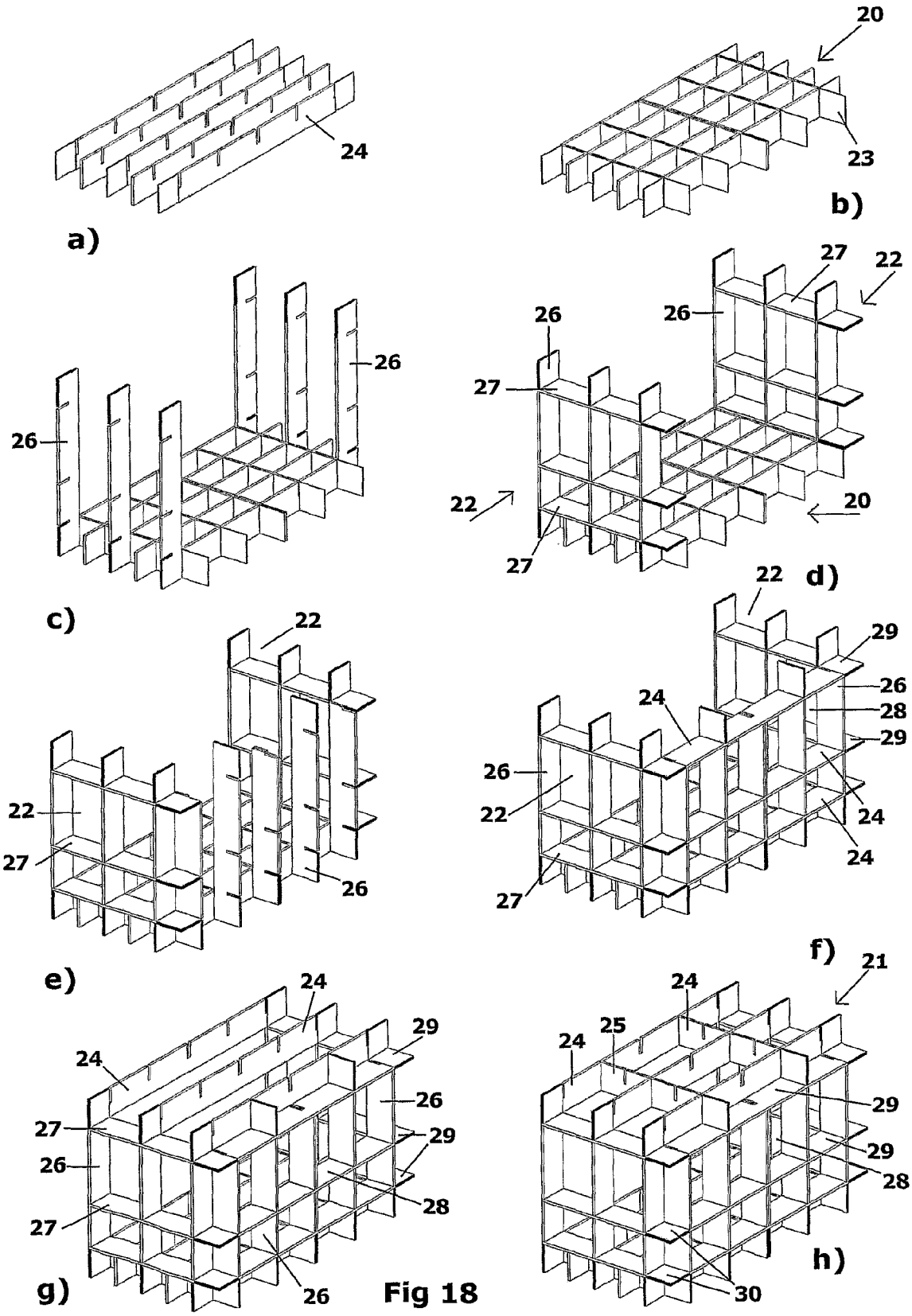
FIGS. 18*a* to 18*h* show steps of building in the construction site a three-dimensional building construction module with the elements of the construction system.

In one version of the method according to the invention, shown in FIG. 18, after the construction of the ceiling grid 21 of the basic module M1 a step of connecting is made of the ends, at least at two levels, of the corresponding flat elements of the opposite walls 22 to the ends of second elements 29 with slots located at equal distances b so that their walls 6 are parallel to the plane of the ceiling and/or the floor. At least two stabilizing girdles 30 are formed crossing at least one third wall 28 of the module connecting its opposite walls 22. In this case one wall 28 is shown in FIGS. 18*f* to 18*h*. It is clear that the horizontal elements of the third wall 28 can have slots located at distance n или e according to the architectural project. The step of intersecting of flat elements 29 of the stabilizing girdles 30 in vertical direction through slots 3 and standing elements 26 having at least two slots located at distance A is made, so that the other walls 28 of the module could be shaped like grid.

Figure 19:
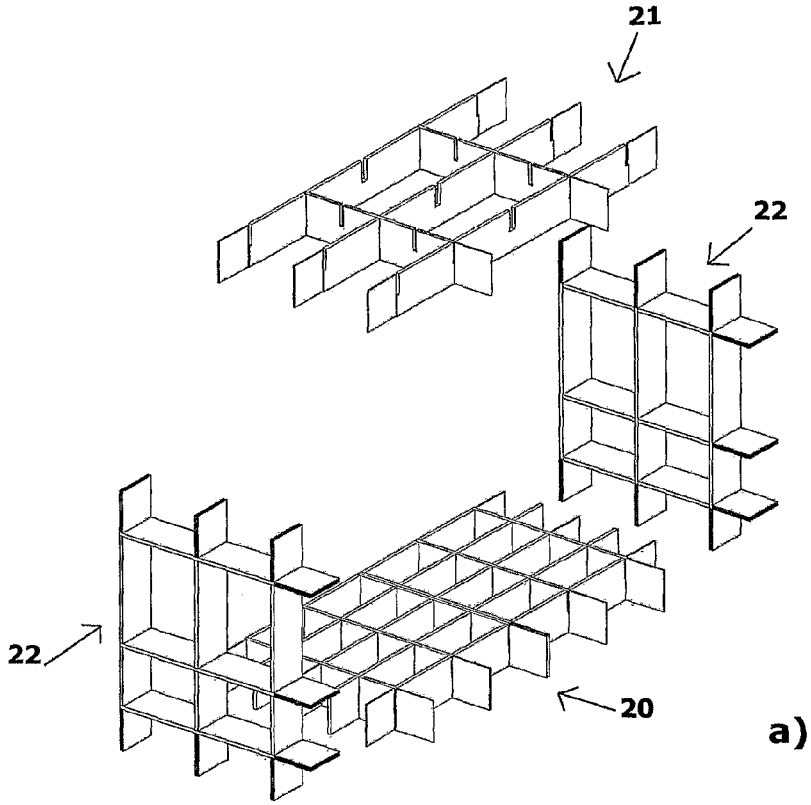
FIGS. 19*a* to 19*c* show steps of a variant of building of the three-dimensional building construction module of FIG. 11 from prefabricated grids of the floor, the ceiling and two opposite walls.
Figure 19:
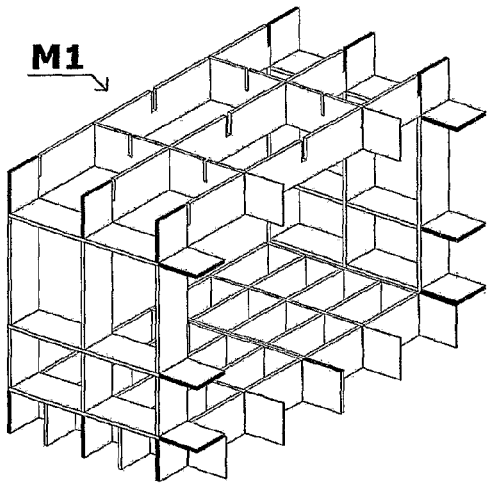
Figure 19:
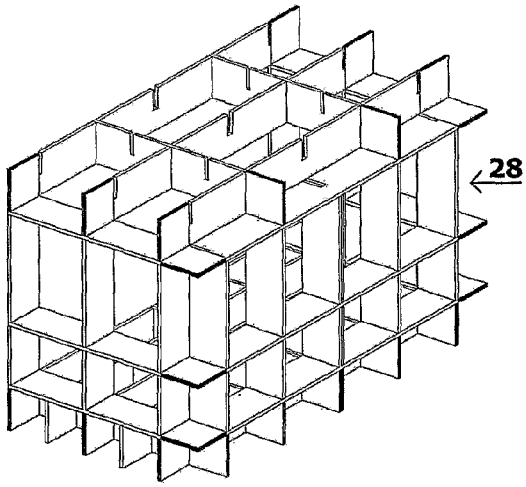
Figure 20:
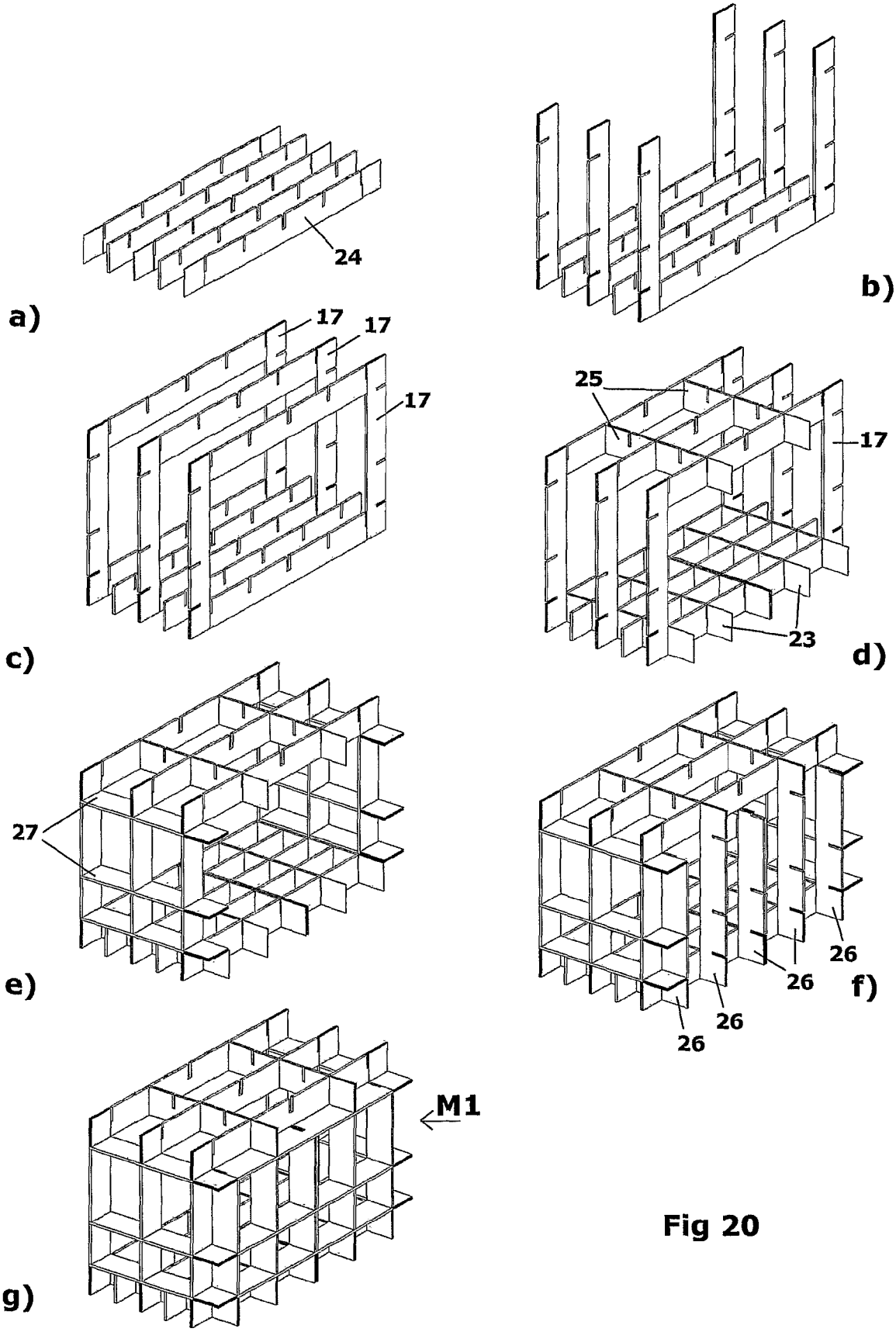
FIGS. 20*a* to 20*f* show another variant for building of a module.

In one preferred embodiment of the method according to the invention, shown in FIG. 19*a* to FIG. 19*c*, the grids of the floor 20, ceiling 21 and walls, in this case 22 and 28, are assembled in advance outside the construction site and are transported to the site assembled.

In another preferred embodiment of the method all modules M1, M2 and M3 (FIGS. 10, 11, 12 and 13) are assembled in advance outside the construction site, are transported to the site, connected and fixed to each other and/or to the foundation.

The modules can be completed in advance (not shown in the drawings) by installing the required installations for electrical, gas and heat supply, elements of the water supply and sewerage installation as well as by covering the interior space with interior walls, ceilings or floors which decreases the cost of construction.

Other architectural projects and modules can also be constructed with the system elements which are not shown in the drawings.

The described exemplary embodiments are just for illustration purposes and do not limit the invention ideas whose scope shall be determined only by the scope of the patent claims.

The invention claimed is:

1. A building construction module made as three-dimensional frame structure shaped like polyhedron including a floor (20), a ceiling (21) and at least two walls (22) connected together characterized by that the floor (20) and the ceiling (21) are grids each one made of intersecting, through slots (3), flat elements (1) having free slots (3) in at least one direction along the module width or length of at least one of the grids of the ceiling (21) and/or floor (20) and the grids are made so that the floor grid (20) of one module can penetrate in the ceiling grid (21) of another module by intersecting through the free slots (3) of the corresponding flat elements (1); at least one of the grids of the floor (20) or the ceiling (21) comprises first flat elements (1) with slots located at equal distances n from each other; at least one of the grids of the ceiling (21) and/or floor (20) comprises second flat elements (1) with slots located at distance b from each other where the ratio n:b is within the range from 1:1 to 1:10, and the second elements (1) with slots at distance b are located in different direction towards the first elements (1) with slots at distance n; the slots (3) at the ends of at least two flat elements (1) of the grids of the ceiling (21) and/or floor (20) are at distance h, equal to at least 0.5c, from the edge of the short side (5) of the element; furthermore, it comprises at least two walls (22) connecting the floor and the ceiling being grids made of connected through slots (3) standing (26) and horizontal (27) flat elements (1) along the height and width of the walls (22) accordingly, so that the corresponding horizontal elements (27) lay at equal distances from the floor (20) thus forming different levels; and the ends of at least two standing elements (26) are connected at an angle to the ends of the corresponding elements (1) of the floor (20) and the ceiling (21).

2. A building construction module according to claim 1 characterized by that the horizontal elements (27) have at least two slots (3) located at distance e from each other and the standing elements (26) have at least two slots (3) located at distance A from each other, where the distances e and A are independent of each other and they are independent of distance n, where each of the distances e and A is within the range from 0.2b to 10b.

3. A building construction module according to claim 1 characterized by that the walls (22) are opposite and the ends of the corresponding horizontal elements (27) of both walls (22) are connected at least at two levels to the ends of second horizontal elements (29) with slots located at equal distances e situated so that the flat walls (6) of the second horizontal elements (29) are parallel to the plane of the ceiling and/or the floor in order to form at least two stabilizing girdles (30) crossing at least one module wall (28) connecting the opposite walls (22); the second horizontal elements (29) of the stabilizing girdles (30) intersect in vertical direction through its slots (3) with standing elements (26) having at least two slots located at distance A, so that the other module walls (28) are formed as grids.

4. A building construction module according to claim 1 characterized by that at least one of wall grids (22, 28) comprises along its width flat elements (1) having slots (3) arranged on alternating sides along the length of the flat elements on both long sides (4) and the distances between the slots (3) on each of both sides (4) are equal to e; and the slots (3) on one side (4) are vacant and are intended for connecting through analogous vacant slots with the wall of another module (M1, M2, M3).

5. Use of the building construction module according to claim 1 as construction toys or for making construction toys.

6. A method for building construction including the steps: parallel arranging of first flat elements with slots at equal distances from each other on a foundation so that said flat elements are perpendicular to said foundation and the slots of one of the long sides of the elements are directed upwards; intersecting through their slots and fixing at an angle second flat elements having slots at equal distances from each other so that a horizontal floor grid is formed with openings with identical dimensions characterized by that it also includes steps for fixing the ends of at least three standing elements (1) with slots (3) to the ends of the first and/or second flat elements (1); intersecting the standing elements (1) through the slots (3) with at least two horizontal elements (1) with slots (3) in order to form grids of at least two walls (22); connecting of the corresponding ends of standing elements (1) to the ends of third elements (1) with slots (3) so that the slots (3) of the one long side (4) of the third elements (1) are directed upwards; and intersecting the third elements (1) through the slots (3) with fourth elements (1) with slots (3) so that a ceiling grid (21) is formed, thus forming an independent module (M1, M2, M3) and at least one of the grids of the ceiling (21), floor (20) or walls (22, 28) has vacant slots (3) for connection to the grids of other modules (M1, M2 and/or M3).

7. A method for building construction according to claim 6 characterized by that the steps for building of grids of floor (20), ceiling (21) and walls (22, 28) of the module (M1, M2, M3) are performed in advance, after which ends of the elements of the wall grids (22, 28) are fixed to the ends of the elements of the floor grid (20) and the ends of the elements of the ceiling grid (21) are fixed to the free ends of the wall grids (22, 28).

8. A method for building construction according to claim 6 characterized by that after the building up of module (M1) it includes the steps of connecting by intersecting through their vacant slots (3) of elements (1) of the walls of the module (M1) with elements (1) of the walls of other prefabricated modules (M1) in horizontal direction so that to form a mutual partition wall grid (40) or by intersecting in vertical direction the vacant slots (3) of the ceiling grid (21) of the module (M1) and the vacant slots (3) of the floor grid (20) of other modules (M2 and/or M3) so that to form a mutual grid (37), and if required it follows a repeating of the above described steps.

9. A method for building construction according to claim 6 characterized by that the modules (M2 and/or M3 and/or M1) are prefabricated outside the construction site, they are transported to the construction site, as in case of need they are connected to each other in horizontal direction through vacant slots (3) on the wall grids (22, 28) and/or are connected in vertical direction through vacant slots on the ceiling grids (21) of the lower module (M1) and on the floor of the upper module (M2, M3) and are fixed to each other and/or to the foundation.

* * * * *